US011136171B1

(12) United States Patent
Ross

(10) Patent No.: US 11,136,171 B1
(45) Date of Patent: Oct. 5, 2021

(54) LID

(71) Applicant: Highwave, Oxnard, CA (US)

(72) Inventor: Gary Ross, Oxnard, CA (US)

(73) Assignee: HIGHWAVE, Oxnard, CA (US)

( * ) Notice: Subject to any disclaimer, the term of this patent is extended or adjusted under 35 U.S.C. 154(b) by 0 days.

(21) Appl. No.: 17/300,092

(22) Filed: Mar. 8, 2021

(51) Int. Cl.
*B65D 47/24* (2006.01)

(52) U.S. Cl.
CPC ..... *B65D 47/247* (2013.01)

(58) Field of Classification Search
CPC ..... B65D 47/247; B65D 47/20
USPC ..... 222/556, 514, 515, 517; 220/254.9, 262, 220/367.1
See application file for complete search history.

(56) References Cited

U.S. PATENT DOCUMENTS 3,739,938 A * 6/1973 Paz ..... A47G 19/2272 220/715
6,935,536 B2 * 8/2005 Tardif ..... A47J 41/0027 222/153.14
8,272,532 B2 * 9/2012 Michaelian ..... A47G 19/2272 220/715
8,985,406 B2 * 3/2015 Tachi ..... A47J 41/0027 222/472
2005/0115977 A1 * 6/2005 Dibdin ..... A47G 19/2272 220/714
2007/0210093 A1 * 9/2007 Pinelli ..... B65D 43/26 220/715
2012/0118890 A1 * 5/2012 Gilbert ..... B65D 43/0225 220/254.9
2013/0056467 A1 * 3/2013 Shepard ..... B65D 51/1683 220/254.9
2015/0230639 A1 * 8/2015 Palmer ..... A47G 19/2211 222/545
2017/0050775 A1 * 2/2017 Sanbar ..... B65D 51/18
2018/0072473 A1 * 3/2018 Salerno ..... B65D 51/2835

* cited by examiner

*Primary Examiner* — Frederick C Nicolas
*Assistant Examiner* — Michael J. Melaragno
(74) *Attorney, Agent, or Firm* — Jonathan E. Grant; Grant Patent Services

(57) ABSTRACT

A lid is disclosed having a spring mechanism that pushes up an activator lever while also lifting up a flow stopper that keeps fluid from the mug and out through the lid. Due to the design of the lid, a mug can be filled without having to remove the lid. Similarly, the user does not have to touch any part of the lid from which water flows. This makes the use of this lid more sanitary.

18 Claims, 10 Drawing Sheets

LID

A lid is discloses having new mechanics of both opening and closing and allowing for the collection of fragrances withing part of the lid.

Figure 1:
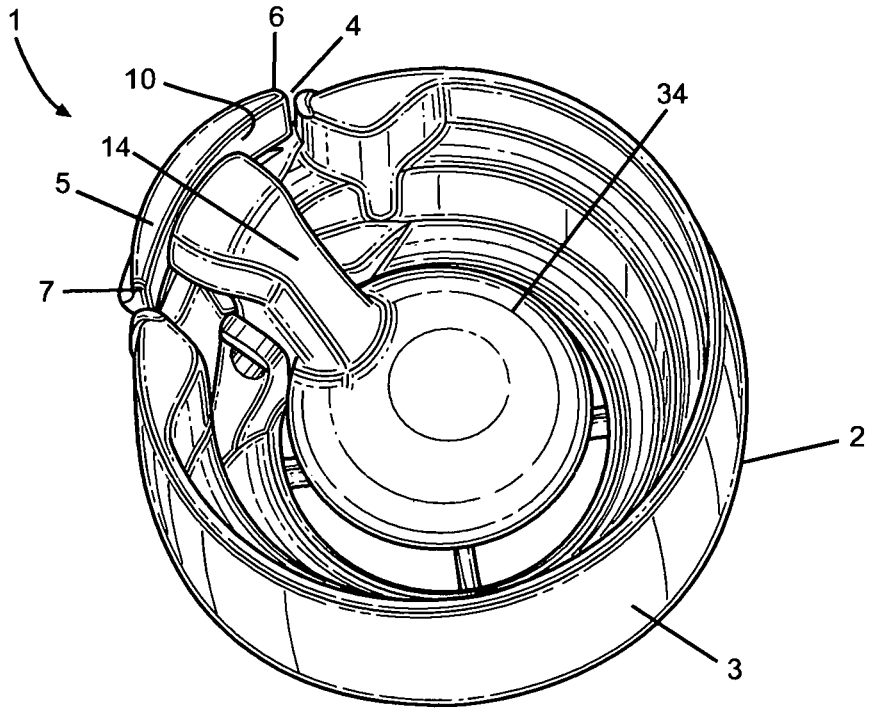
FIG. 1 is a perspective overhead view of a lid in a "closed" position.
Figure 2:
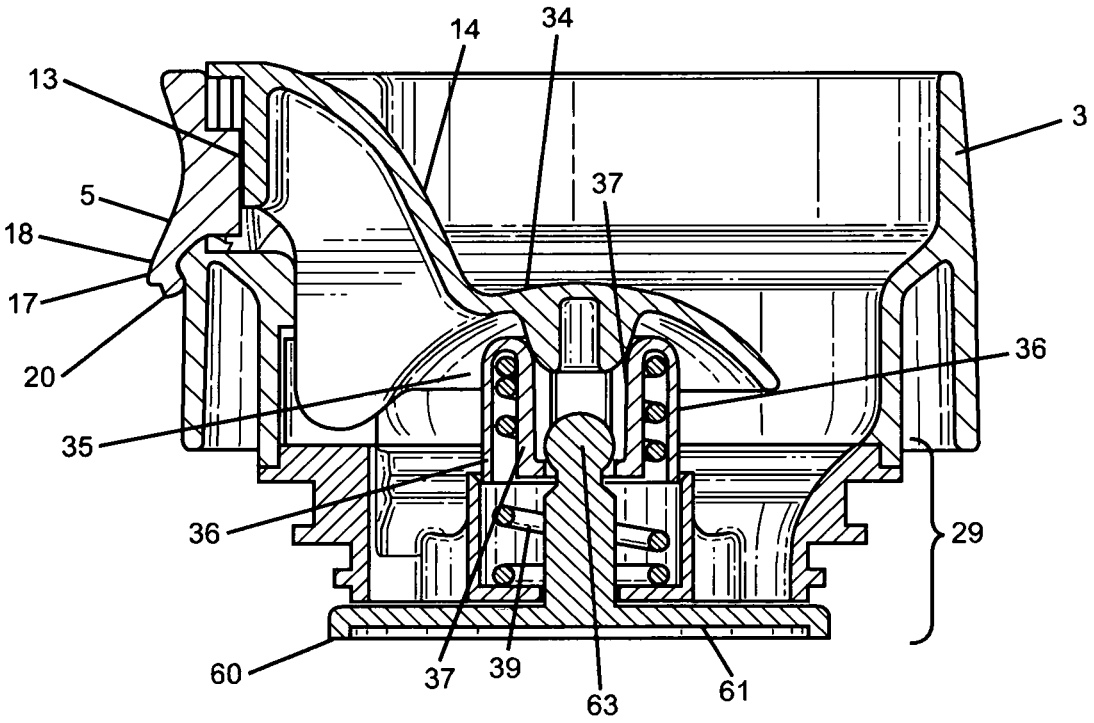
FIG. 2 is a cross-sectional view of the closed lid of FIG. 1.
Figure 3:
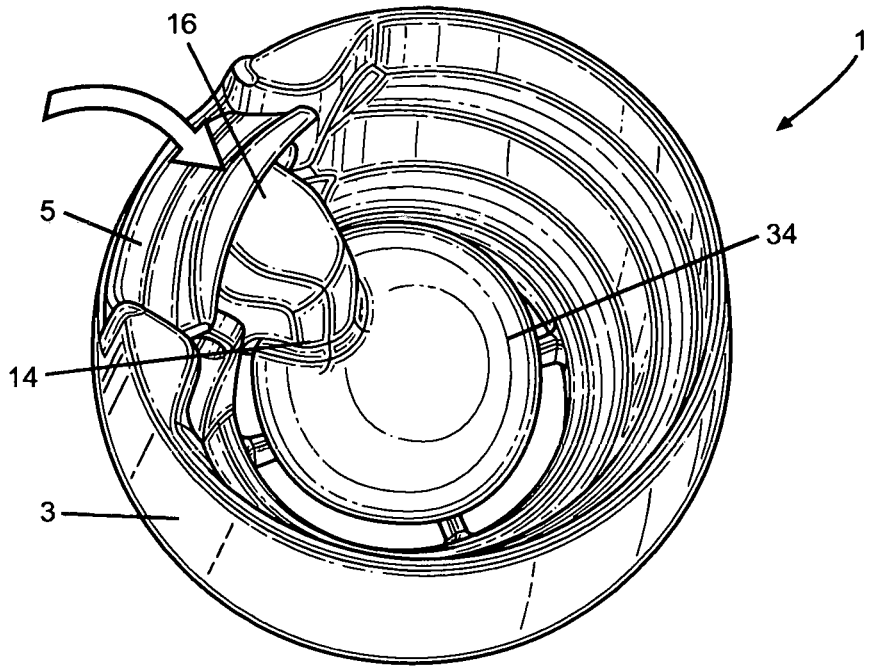
FIG. 3 is an perspective overhead view of the underside of the lid in in the "open" position.
Figure 4:
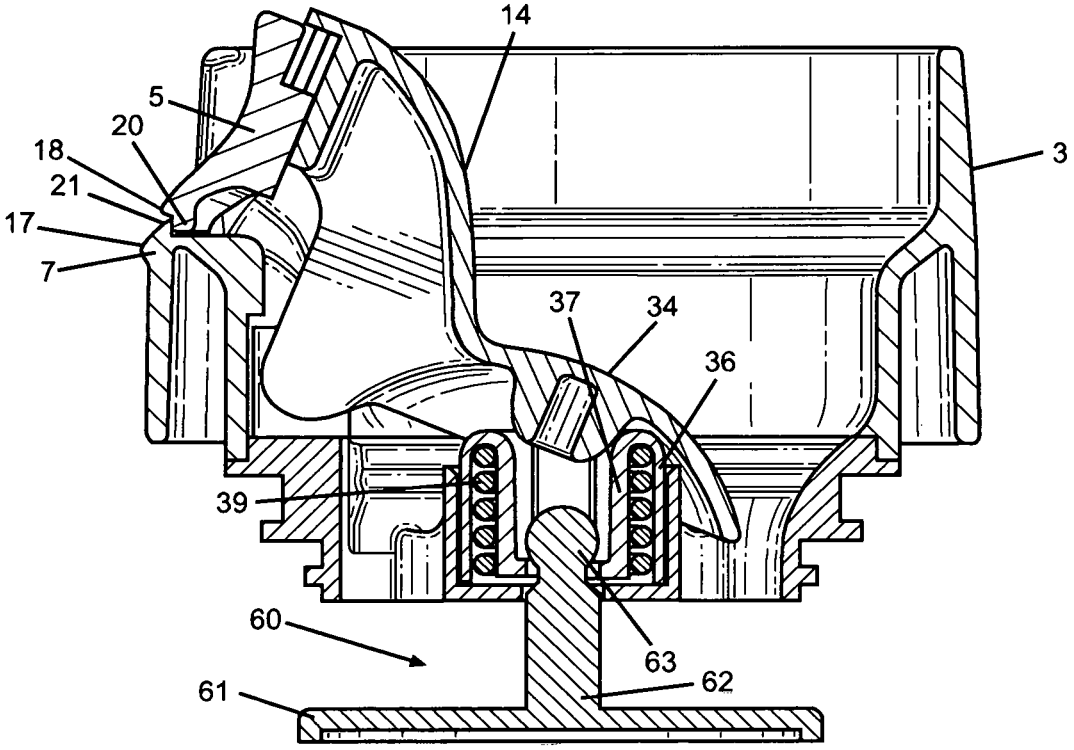
FIG. 4 is a cross section of the lid in the "open" position.
Figure 5A:
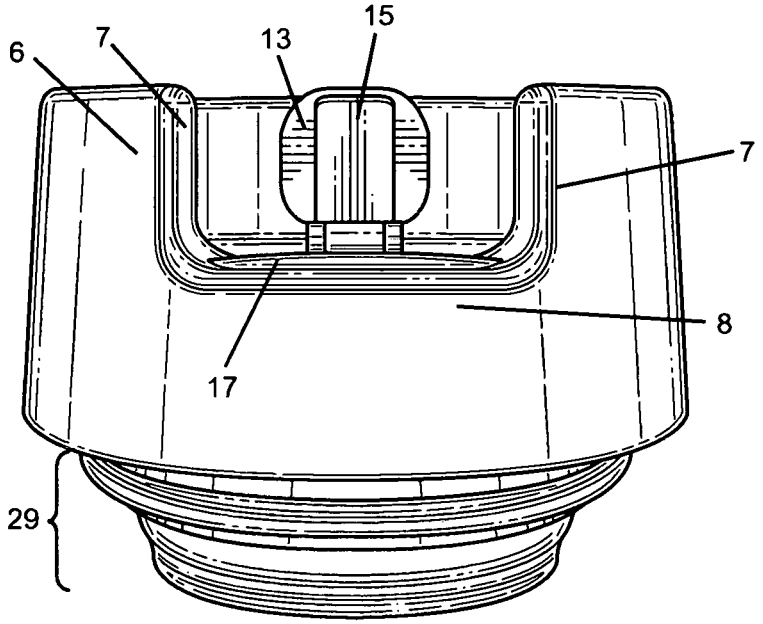
FIG. 5*a* is an front view of the button attachment face and of the lid.
Figure 5B:
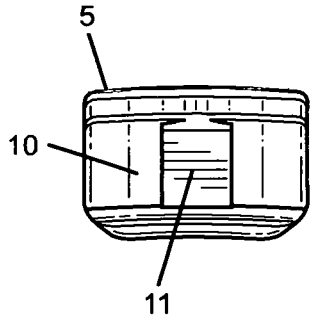
FIG. 5 *b* is the back of the button.
Figure 6:
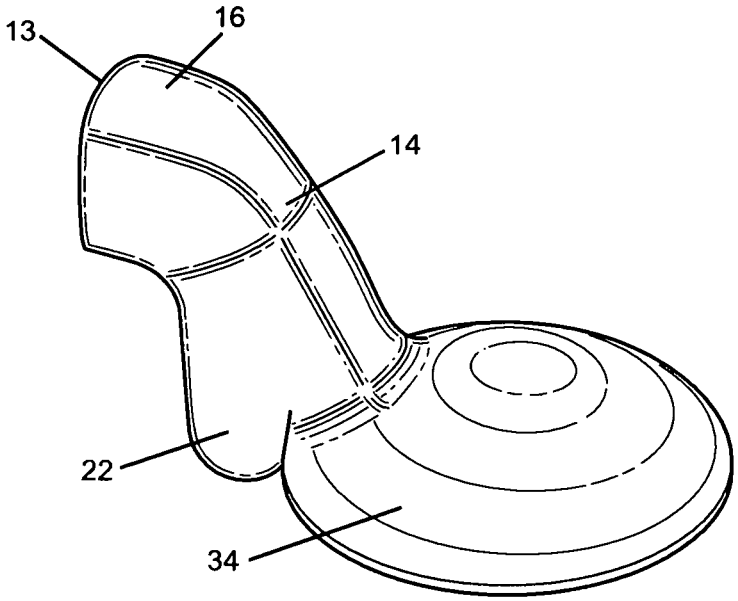
FIG. 6 is a perspective view of the remote activator lever.
Figure 7:
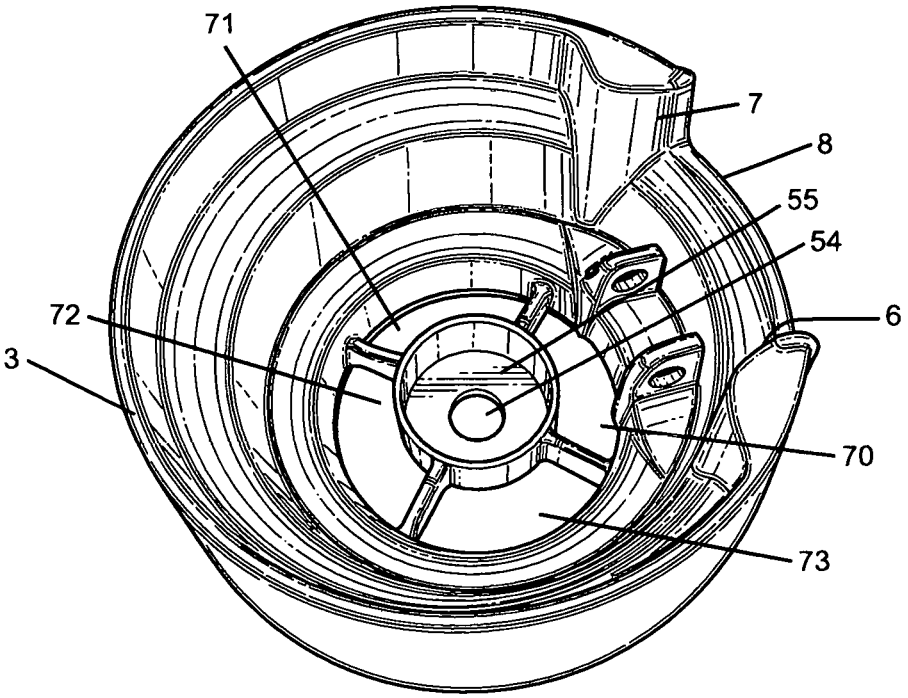
FIG. 7 is an overhead perspective view of the inside of the lid without the remote activator lever in place.
Figure 8:
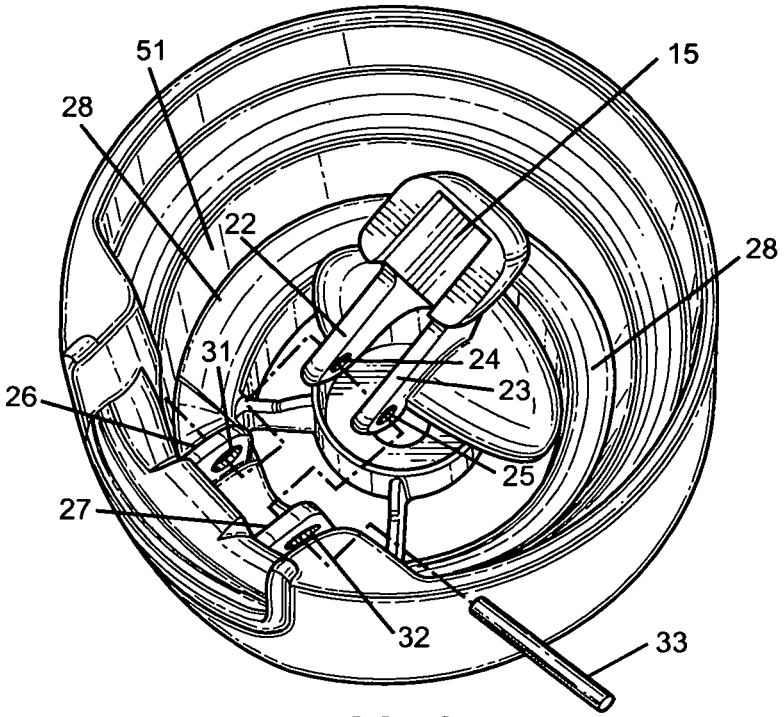
FIG. 8 is an overhead perspective view of the connection holding the remote activator lever.
Figure 9:
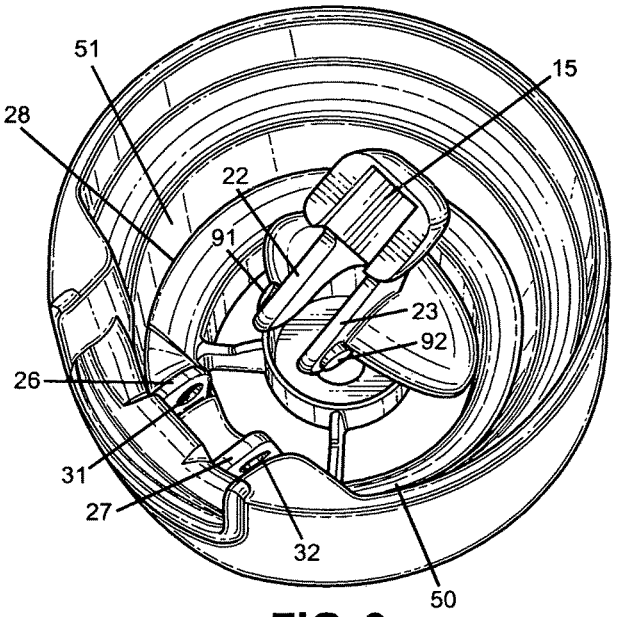
FIG. 9 is an overhead perspective view of another embodiment of the connection holding the remote activator lever.
Figure 10:
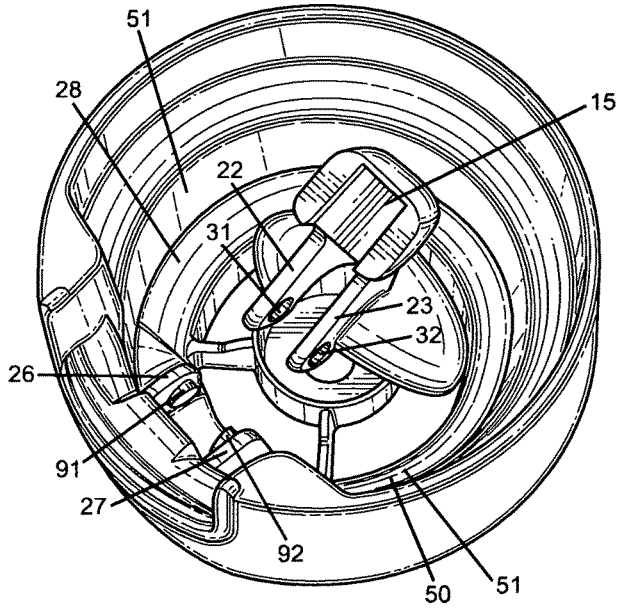
FIG. 10 is an overhead perspective view of yet another embodiment of the connection holding the remote activator lever.
Figure 11:
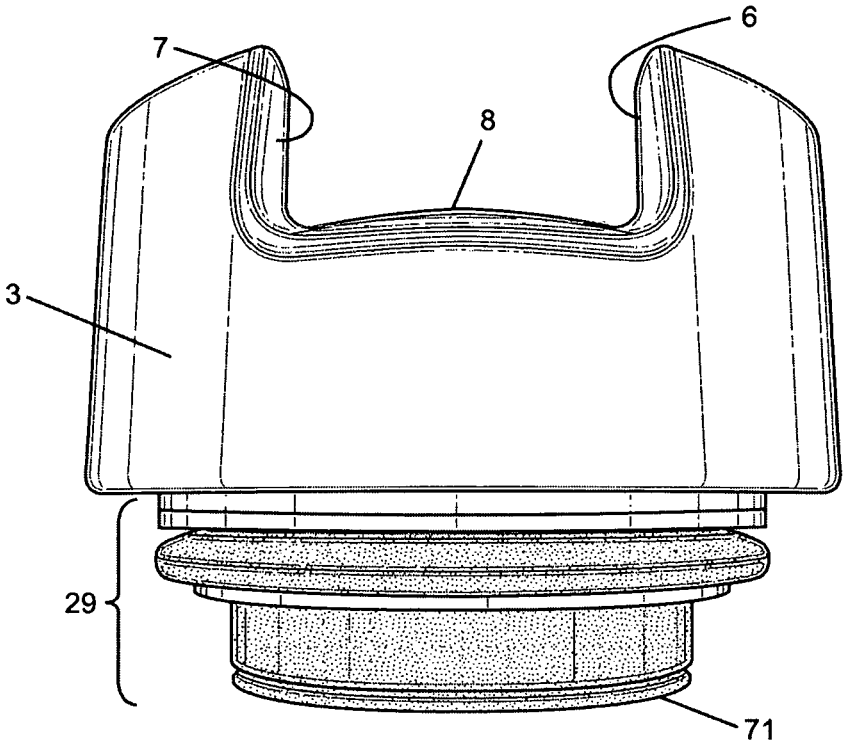
FIG. 11 is a front view showing the opening in the side of the lid.
Figure 12:
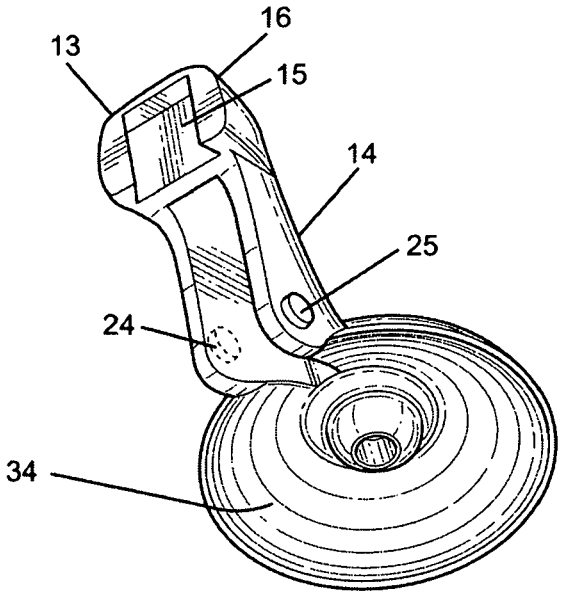
FIG. 12 is a perspective underside view of the remote activator lever.
Figure 13:
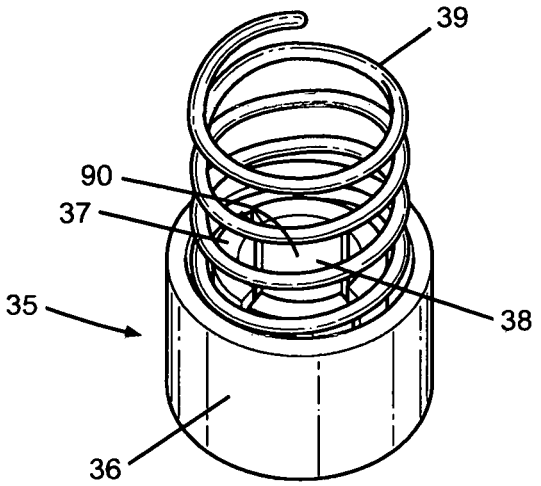
FIG. 13 is a perspective view of the underside of the pushport.
Figure 14:
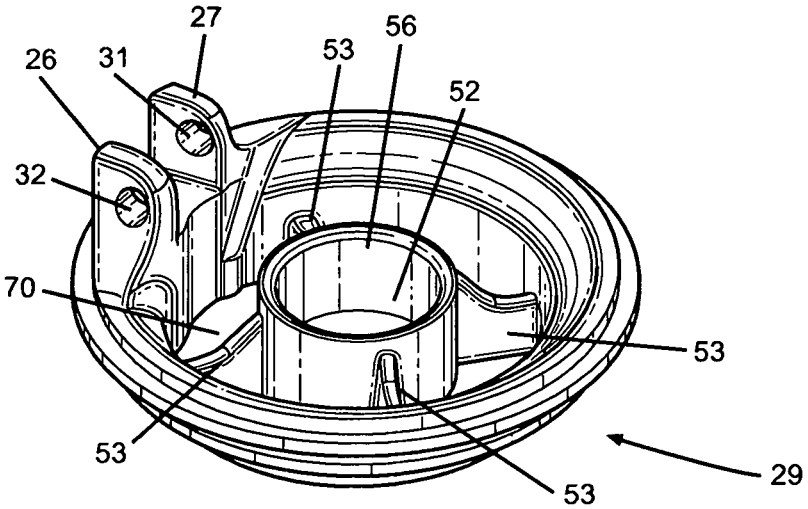
FIG. 14 is a top perspective view of a lid substructure.
Figure 15:
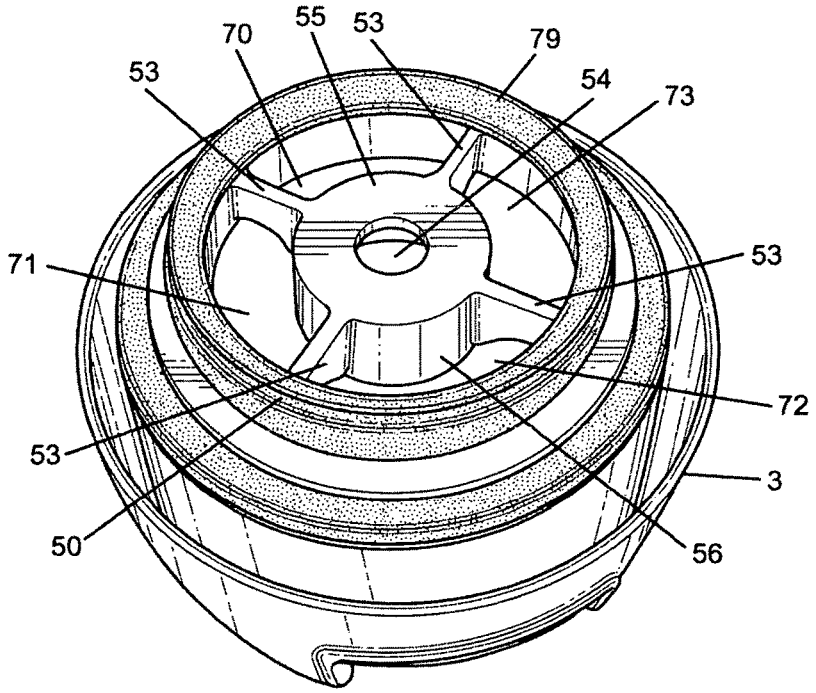
FIG. 15 is an underside perspective of the lid showing the lid substructure.
Figure 16:
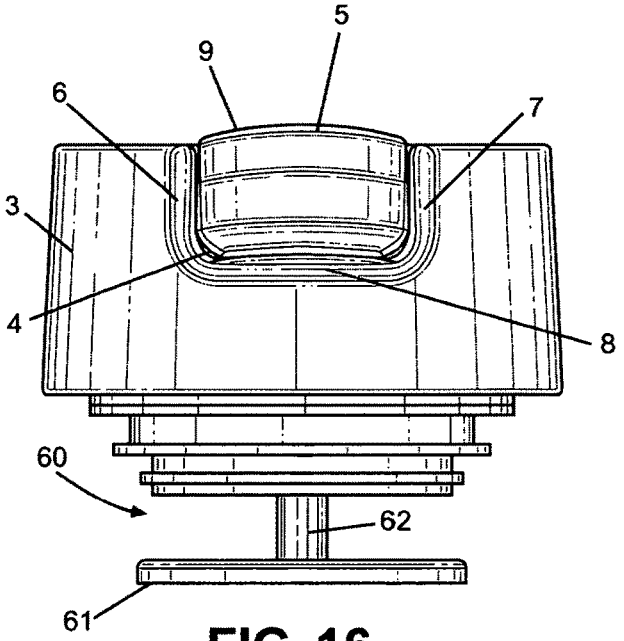
FIG. 16 is a front view of the lid when in the open position.
Figure 17:
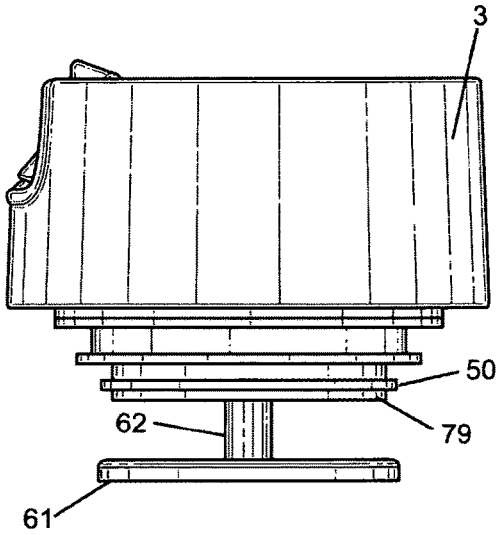
FIG. 17 is a side view of the lid when in the open position.
Figure 18:
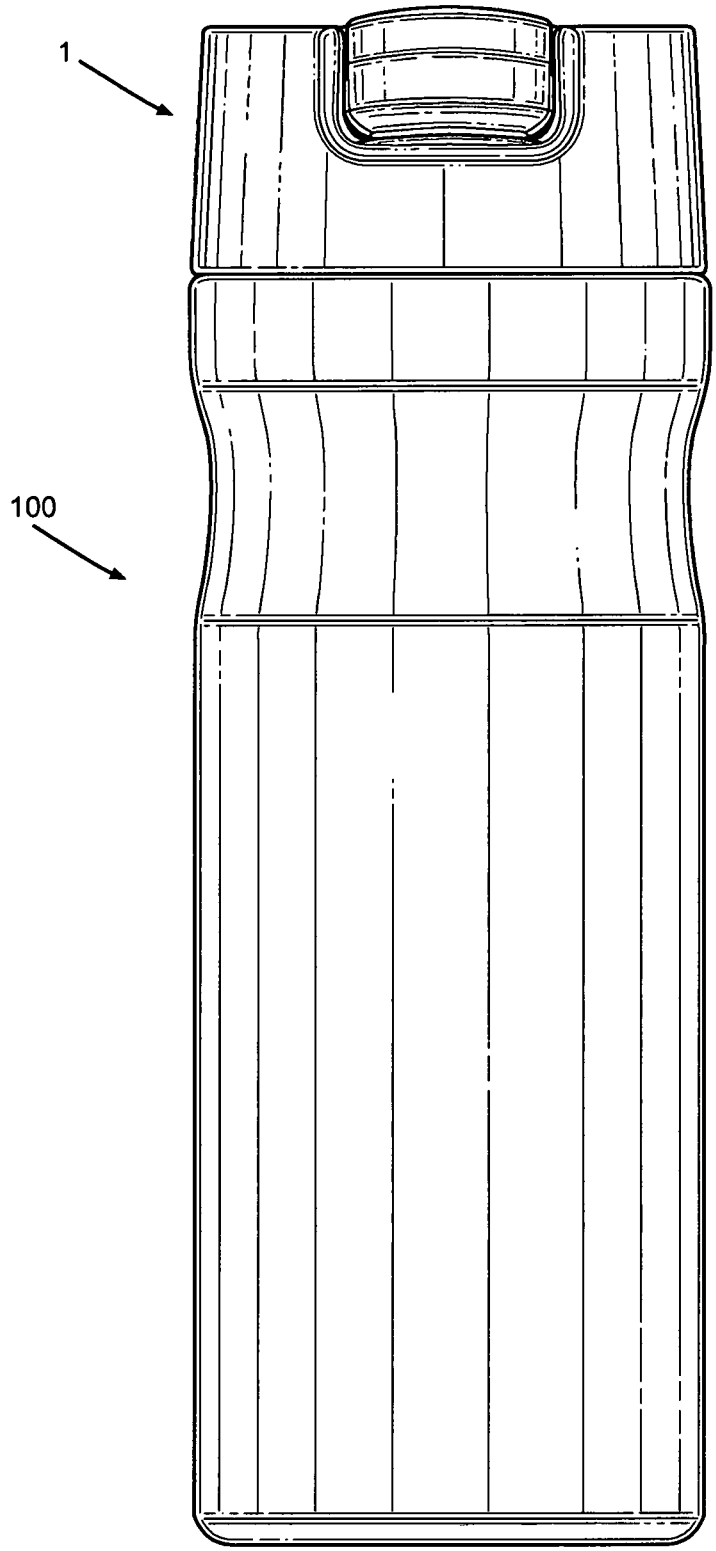
FIG. 18 is a front perspective view of the lid positioned on the mug.
Figure 19:
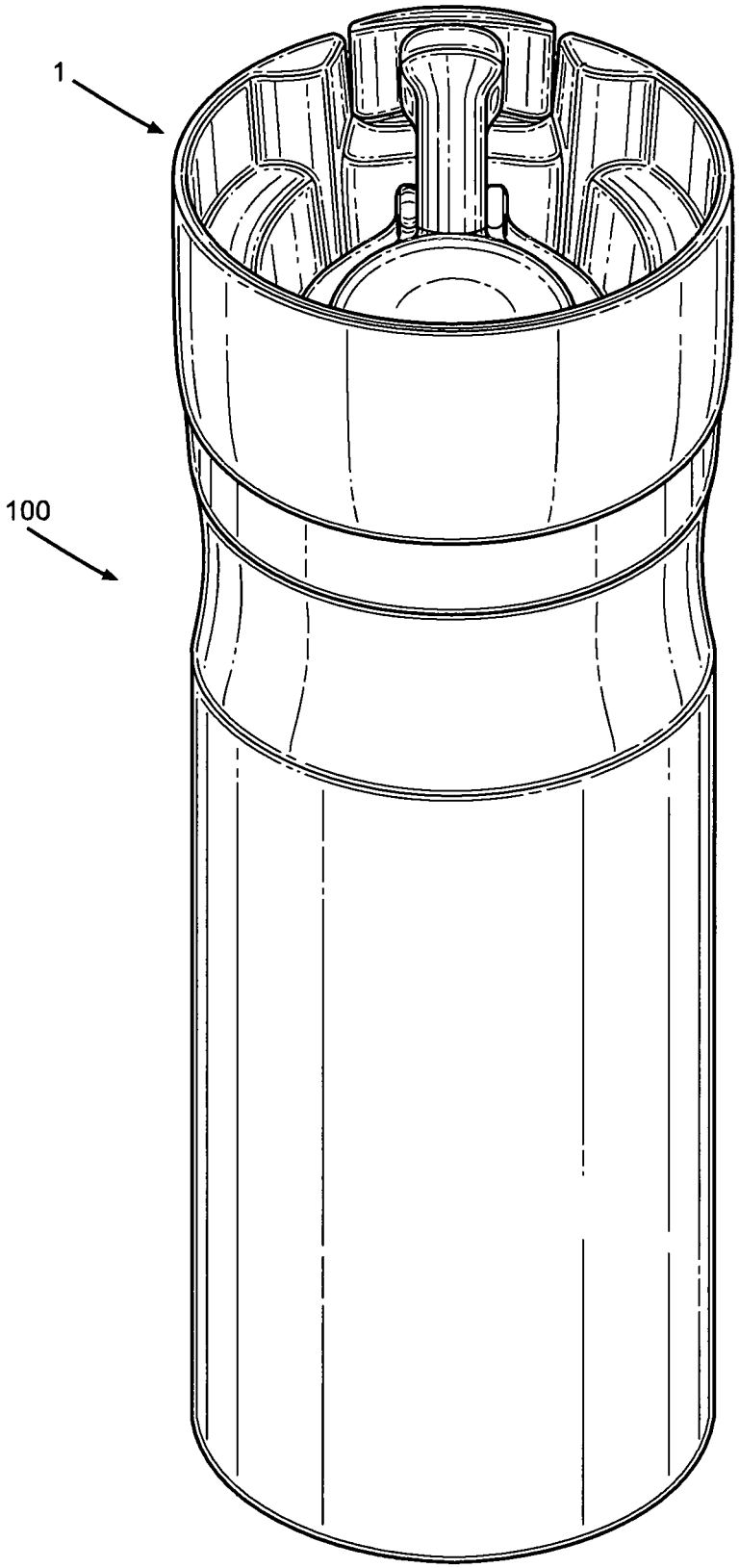
FIG. 19 is a top perspective view of the lid positioned on the mug.

The figures depict various embodiments of the described methods and kit and are for purposes of illustration only. One skilled in the art will readily recognize from the following discussion that alternative embodiments of the methods and kits illustrated herein may be employed without departing from the principles of the methods and kits described herein.

DETAILED DESCRIPTION OF THE EMBODIMENT

The disclosed lid 1 features a body 2. In one embodiment, the body 2 is a circular shaped wall 3. There is an opening 4 in the body to for a tab or button 5. The opening 4 can be almost any shape and in one embodiment corresponds to the shape of the button that fits within at least three sides 6, 7, 8 of the opening. In one embodiment, this opening 4 is rectangular in shape. In another embodiment, the opening 4 is square and in another embodiment, the opening 4 is round. In another embodiment, the top of the opening 4 has no side.

The back side 10 of the button or latch 5 is connected by any means known in the art to one end of the remote activator lever 14 of a button attachment face 13. In one embodiment, the back of button 5 has a length slide connector jointer fixing bracket 11 which mates with a length slide sliding connector jointer fixing bracket or slide indentation 15 incorporated on the front of the button attachment face 13 such that the button 5 can slide up and down. In one embodiment, there is a rim 17 at least on the bottom 8 of the opening 4. In another embodiment, the rim 17 extends around the opening 4. In the same embodiment, the bottom 18 of the button 5 flares outward, and behind the flared bottom 18 is a lip 20. When the button or latch 5 is pushed down, the lip 20 slides over the rim 17 and is reversibly locked in place. The button 5 releases from the lip 20 when pressed. In another embodiment, when in the "open" position, the button 5 has the ability to slide down behind the back of the rim and lock the activator lever 14 in an open position. To unlock the activation lever 14, the user using his thumb or other finger pushes and lifts the button 5, allowing it to return to the "closed" position. In one embodiment, the button attachment face 13 is positioned perpendicular to the button or positioned at a light downward angle. In another embodiment, the button attachment face 13 is positioned from about 5 degrees to about 45 degrees downward. In one embodiment, there is a button face spacer 16, positioned behind and in communication with the button attachment face 13.

Attached or integral with the other end of button face spacer 16 or directly behind the is a remote activator lever 14. Integral with and positioned on the underside of the activator lever are two downwardly descending walls 22, 23, parallel with each other and each having parallel and hole 24, 25. The two downwardly descending walls 22, 23 fit between two upwardly positioned walls 26, 27, the latter walls 26, 27 attached to or integral with a top inner rim 28 of a lid substructure 29. The top inner rim 28 positioned at the distal end of the lid substructure 29 is connected to a proximal rim 51 of the circular shaped wall 3. Holes 31, 32 is positioned through both upwardly positioned walls 26, 27. These holes 31, 32 are aligned with the holes 24, 25 of the two downwardly descending walls 22, 23 and an axle 33 in the form of a pin or screw or the upwardly positioned walls 26, 27 can be squeezed to fit within the outer walls 22, 23 into the correct position.

In yet another embodiment, the upwardly positioned walls 26, 27 instead extend inwardly from the circular shaped walls 3 instead of extending upwardly from the with a top or distal inner rim 28 of a lid substructure 29.

In yet another embodiment, projections 91, 92 extend from and the outside walls of walls the two downwardly descending walls 22, 23. These projections 91, 92 fit into holes 31, 32 of the upwardly positioned walls 26, 27. Insertion of the downwardly projecting walls 22, 23 can be done by squeezing the walls and positioning the downwardly inserting walls between the upwardly positioned walls until the projections 91, 92 are properly fitted into the holes 31, 32.

In another embodiment, the downwardly descending walls 22, 23 have holes 24, 25 and the upwardly positioned walls 26, 27 each have an inwardly positioned projection 91, 92.

Any number of agents of parts known in the art can create the pivot point, including other hinge mechanisms.

The remote activator lever 14 is attached to or integral with a remote activator 34. More specifically, in one embodiment, the remote activator lever 14 is positioned at about a −5 degree to about a −45 degree angle from a Y axis. In another embodiment, the remote activator lever 14 is positioned at an angle between about −12 degrees and about −27.50 degrees. The angle of the handle allows for ease of use, and for greater torque. It takes very little effort to open and close the lid. In one embodiment 34, the remote activator 34 is a hollow semi-spheric. In one embodiment, the semi-spheric remote activator tend to catch steam and aroma thereby enhancing flavor when the lid is open. In another embodiment, the remote activator 34 is flat. In another embodiment, the remote activator 34 is a hollow square. In another embodiment, the button face spacer 16 is positioned at an angle of about −5 degrees to about −15 degrees from the x-axis.

A pushport 35 is positioned, attached to or integral with the underside of the remote activator 34. The pushport 35 is in the shape of a hollow plug. In one embodiment, the hollow plug version of the pushport 35 has an outer wall 36 and an inner wall 37. The inner wall 37 forms an opening 38 in the middle of the bottom of the pushport 35 and in one embodiment the opening extends through the entire length of the pushport 35.

In one embodiment, a spring 39 is downwardly positioned around from the inside wall 37 of the pushport 35.

The lid substructure 29 has, at its proximal end, a flow stopper port 52, centered by a plurality of connecting rods 53. The flow stopper port 52 has an opening 54 through a bottom floor 55. In one embodiment, a central port wall 56 encircles the bottom floor 55. Beneath the lid substructure is a flow stopper 60, having a flat fluid blocker 61 in the shape of a flat circular disk matching or similar to the circumference of the rim 50 or the gasket 79, and a centralized stem 62 centralized, on top of, and perpendicular to the flat fluid blocker 61. In one embodiment, the centralized stem 62 has at its distal end a rounded tip or rounded end section 63. The fluid blocker 61, is, like the other parts of this lid, is plastic and impermeable to fluid.

In one embodiment, the flat fluid blocker 61 of the flow stopper 60 is positioned up against a gasket 79 positioned on the perimeter of the outside of the bottom floor 55. When closed, this prevents water from entering through the plurality of apertures 70, 71, 72, 73 bounded by the circular shaped wall 3. The centralized stem 62 fits through the opening 54 of the flow stopper port 52 of the lid substructure 29. The centralized stem 62 continues and fits through the center of the spring 39. The distal end of the centralized stem 62 which in one embodiment comprises the rounded/bulbous tip or end section 63 held in place by a flexible top 90 at the proximal end of the inner wall 37 of the pushport 35. The top or distal end of the pushport 35 is positioned up against the underside of the remote activator 34.

The spring 39, which at its proximal end is positioned against the bottom floor 55 of the flow stopper port 52 keeps the distal end of the pushport 35 and in fact the entire pushport 35 pushed up against the underside of the remote activator 34 which in turn pushes the activator lever 14 which in turn pushes the button 5 into the closed position.

To open the lid 1, a person presses the button 5, disengaging the button 5 from the circular shaped wall 3, and the remote activator lever 14 pushes the remote activator 34 downward. This is in turn leads to the remote activator 34 pushing down on the pushport 35 which in turn pushes down on the flow stopper 60, allowing fluids to be poured from the mug or bottle 100 and through the apertures 70, 71, 72, 73.

There is no need to detach the lid fill or re-fill the bottle/mug 100. One merely has to press the button, the flow stopper 60 is pushed downward and water can flow from a tap and through the apertures into the bottle/mug 100.

In another embodiment of this disclosure, there is no separate pushport 34. In such an embodiment, the distal end of the centralized stem 62 of the flow stopper 60 is integral with or connected to the underside of the remote activator 34. The spring 39 is positioned between the bottom floor 55 of the flow stopper 60 and the underside of the remote activator.

In another embodiment, the button 5 is non-locking.

The embodiments disclosed in this application are to be considered in all respects as illustrative and not limiting. The scope of the disclosure is indicated by the appended claims rather than by the foregoing description, and all changes which come within the meaning and range of equivalency of the claims are intended to be embraced therein.

The invention claimed is:

1. A lid, comprising:

a) A button:

b) A circular wall, said circular wall having a wall opening for said button, each end of said circular wall being open;

c) a lid substructure, said lid substructure being circular, a distal end of said lid substructure being attached to a bottom end of said circular wall, said lid substructure comprising:

i) a rim;

ii) a flow stopper port centered within the rim, said flow stopper port comprising:

1) a bottom floor; and 2) a hole in the bottom floor;

iii) a plurality of connecting rods connecting and centering the flow stopper port to the rim;

iv) fluid passageways formed by and positioned between said connecting rods;

d) a remote activator lever, said remote activator lever connected at a first end to said button and pivotable about an x-axis;

e) a remote activator, said remote activator connected to a second end of said remote activator lever;

f) a pushport positioned between an underside of said remote activator and the flow stopper port of the lid substructure, said pushport being a port open on at least a proximal end;

g) a flow stopper, said flow stopper comprising:

i) a flat circular disk capable of covering the fluid passageways, preventing fluid flow, said flat circular disk positioned under the lid substructure; and ii) a centralized stem which is centralized, perpendicular to and extending upward from the flat circular disk, said centralized stem extending up through said hole in the bottom floor of said lid substructure and held in place by said pushport; and h) a spring positioned between said bottom floor of said flow stopper port and the pushport, said spring having enough strength and to push up said pushport such that the remote activator and the remote activator lever are pushed upwards.

2. The lid of claim 1, further comprising a rim positioned at least on the bottom of the wall opening.

3. The lid of claim 2, further comprising a lip on the bottom of the button to interact with the rim said positioned at least on the bottom of the wall opening to allow for locking and unlocking of the button.

4. The lid of claim 3, further comprising a button attachment face in communication with or integral with the remote activator lever.

5. The lid of claim 4, where said remote activator lever is integrally molded with a) said button attachment face; and b) said remote activator.

6. The lid of claim 4, further comprising:

a) a slide connector bracket attached to a back of the button;

b) a complementary sliding bracket on the button attachment face allowing for the button to be slid up and down.

7. The lid of claim 6, wherein said button has the capability of locking the activator lever in an open position by sliding said lip of said button behind said rim.

8. The lid of claim 1, wherein said remote activator lever is positioned angularly to said remote activator.

9. The lid of claim 1, wherein said pushport comprises:

a) an outside wall; and b) an inside wall, said inside wall having a flexible top opening at a proximal end of said inside wall.

10. The lid of claim 9, wherein a distal end of the centralized stem comprises rounded/bulbous end section which is secured in to the flexible top opening of the inside wall of the pushport.

11. A lid, comprising:

a) a button:

b) a circular wall, said circular wall having an opening for said button, each end of said circular wall being open;

c) a lid substructure, said lid substructure being circular, a distal end of said lid substructure being attached to said proximal end of said circular wall, said lid substructure comprising:

i. a rim;

ii. a flow stopper port centered within the rim, said flow stopper port comprising:

1) a bottom floor; and 2) a hole in the bottom floor;

iii. a plurality of connecting rods connecting and centering the flow stopper port to the rim;

iv. fluid passageways formed by and positioned between said connecting rods;

A) a remote activator lever, said remote activator lever connected at a first end to said button and pivotable about an x-axis;

B) a remote activator, said remote activator connected to a second end of said remote activator lever;

C) a flow stopper, said flow stopper comprising:

I) a flat circular disk capable of covering the fluid passageways, preventing fluid flow, said flat circular disk positioned under the lid substructure; and II) a centralized stem which is centralized, perpendicular to and extending upward from the flat circular disk, said centralized stem extending up through said hole in the bottom floor of said lid substructure and held in place by said pushport; and D) a spring positioned between said bottom floor of said flow stopper port and an underside of the remote activator, said spring having enough strength that the remote activator and the remote activator lever are pushed upwards.

12. The lid of claim 11, further comprising a rim positioned at least on the bottom of the wall opening.

13. The lid of claim 12, further comprising a lip on the bottom of the button to interact with the rim positioned at least on the bottom of the wall opening to allow for locking and unlocking of the button.

14. The lid of claim 12, further comprising a button attachment face in communication with or integral with the remote activator lever.

15. The lid of claim 14, where said remote activator lever is integrally molded with:

a) said button attachment face; and b) said remote activator.

16. The lid of claim 14, further comprising:

a) a slide connector bracket attached to a back of the button;

a complementary sliding bracket on the button attachment face allowing for the button to be slid up and down.

17. The lid of claim 14 wherein said button has the capability of locking the activator lever in an open position by sliding said lip of said button behind said rim.

18. The lid of claim 11, wherein said remote activator lever is positioned angularly to said remote activator.

* * * * *